US006684739B2

(12) United States Patent
Hsieh

(10) Patent No.: US 6,684,739 B2
(45) Date of Patent: Feb. 3, 2004

(54) HAND TOOL ANGLE ADJUSTMENT STRUCTURE

(76) Inventor: Chih-Ching Hsieh, 235 Chung - Ho Box 8-24, Taipei (TW)

( * ) Notice: Subject to any disclaimer, the term of this patent is extended or adjusted under 35 U.S.C. 154(b) by 0 days.

(21) Appl. No.: 10/201,353

(22) Filed: Jul. 18, 2002

(65) Prior Publication Data

US 2003/0015069 A1 Jan. 23, 2003

(30) Foreign Application Priority Data

Jul. 19, 2001 (TW) ..... 90212406 U

(51) Int. Cl.[7] ..... B25B 23/16
(52) U.S. Cl. ..... 81/177.7; 403/73
(58) Field of Search ..... 81/177.7, 177.8, 81/177.9, 177.75; 403/73, 74, 91; 464/115

(56) References Cited

U.S. PATENT DOCUMENTS 1,038,539 A * 9/1912 Douglas ..... 81/177.7
1,448,962 A * 3/1923 Hughes ..... 81/177.7
4,065,941 A * 1/1978 Aoki ..... 464/115
4,277,992 A * 7/1981 Koltveit ..... 81/177.75
4,711,145 A * 12/1987 Inoue ..... 81/177.8

* cited by examiner

*Primary Examiner*—D. S. Meislin
(74) *Attorney, Agent, or Firm*—Alan D. Kamrath; Rider Bennett, LLP

(57) ABSTRACT

A hand tool angle adjustment structure includes a handle having a substantially U-shaped front coupling portion with a through hole and a screw hole at two sides, a work head, the work head having a flat, circular coupling portion extended from a rear side thereof and coupled to the U-shaped front coupling portion of the handle and a mounting hole extended through two opposite lateral sides of the coupling portion, and a lock bolt inserted through the through hole of the handle and the mounting hole of the work head and threaded into the screw hole of the handle to secure the work head to the handle for enabling the work head to be tilted leftwards/rightwards or turned forwards/backwards within a limited angle.

3 Claims, 8 Drawing Sheets

HAND TOOL ANGLE ADJUSTMENT STRUCTURE

BACKGROUND OF THE INVENTION

The present invention relates to hand tools, and more specifically, to an angle adjustment structure for hand tool that enables the work head of the hand tool to be tilted leftwards/rightwards or turned forwards/backwards relative to the tool handle within a limited angle.

A variety of wrenches have been disclosed for grasping nuts, bolts, etc., and have appeared on the market. The work angle of regular wrenches is not adjustable. There are wrenches with adjustable work angle. FIGS. 1~3 show different wrenches with adjustable work angle. The wrench shown in FIG. 1 comprises an elongated handle and two hex sockets respectively pivoted to the ends of the handle. The wrench shown in FIG. 2 comprises an elongated handle having a fixed open end at its one end and a hex socket pivoted to its other end. The wrench shown in FIG. 3 comprises an elongated handle having a fixed open end at its one end and a ratchet box end pivoted to its other end. According to the aforesaid design, the angular position of the hex socket or ratchet box end of the wrench can be adjusted in one direction only.

SUMMARY OF THE INVENTION

The present invention has been accomplished under the circumstances in view. It is one object of the present invention to provide a hand tool angle adjustment structure, which enables the work head of the hand tool to be tilted leftwards/rightwards relative to the tool handle within a limited angle. It is another object of the present invention to provide a hand tool angle adjustment structure, which enables the work head of the handle tool to be turned forwards/backwards relative to the tool handle within a limited angle. To achieve these and other objects of the present invention, the hand tool angle adjustment structure includes a handle having a substantially U-shaped front coupling portion with a through hole and a screw hole at two sides, a work head, the work head having a flat, circular coupling portion extended from a rear side thereof and coupled to the U-shaped front coupling portion of the handle and a mounting hole extended through two opposite lateral sides of the coupling portion, and a lock bolt inserted through the through hole of the handle and the mounting hole of the work head and threaded into the screw hole of the handle to secure the work head to the handle. The mounting hole of the work head has a narrow middle portion fitting the outer diameter of the lock bolt and two expanded end portions of oblong cross section at two distal ends thereof. When assembled, the work head can be turned forwards/backwards about the lock bolt, or tilted leftwards/rightwards within a limited angle relative to the handle.

DETAILED DESCRIPTION OF THE PREFERRED EMBODIMENT

Figure 1:
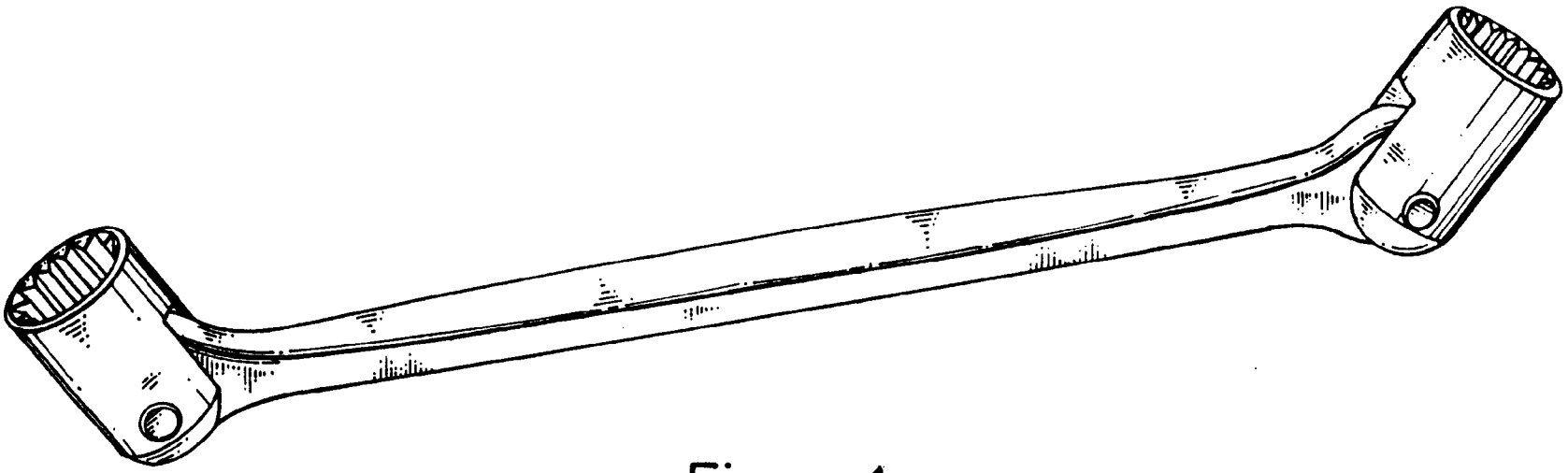
Fig. 1 PRIOR ART
FIG. 1 illustrates a wrench according to the prior art.
Figure 2:
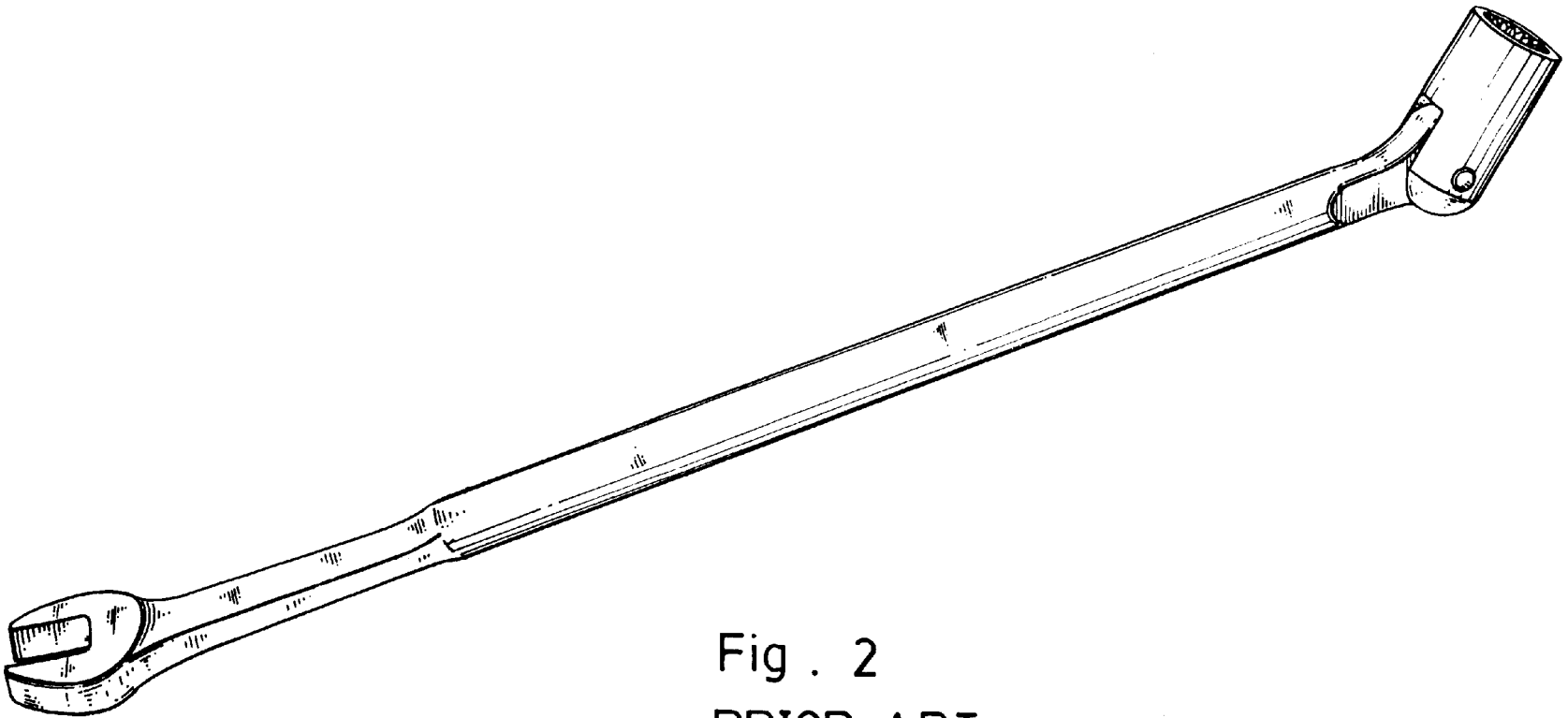
Fig. 2 PRIOR ART
FIG. 2 illustrates another design of wrench according to the prior art.
Figure 3:
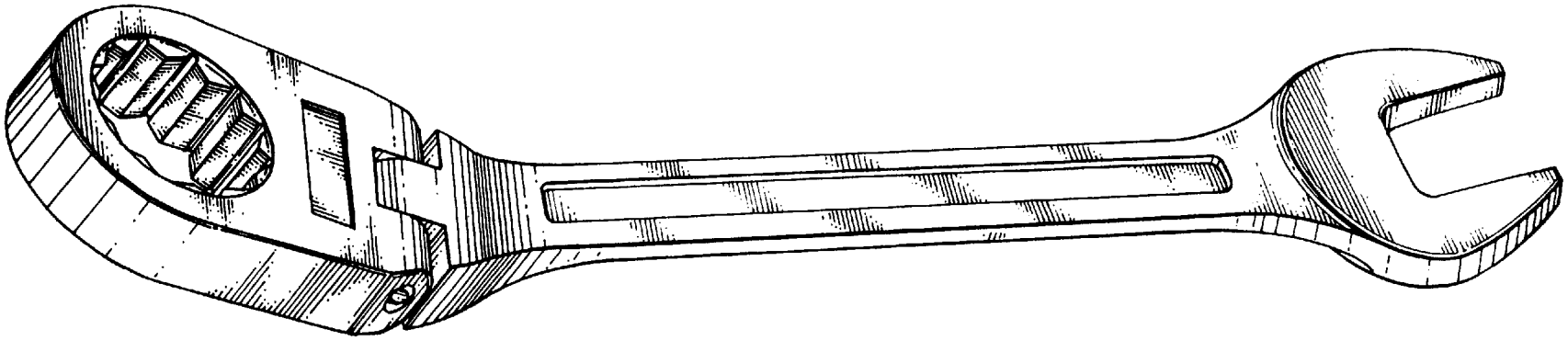
Fig. 3 PRIOR ART
FIG. 3 illustrates still another design of wrench according to the prior art.
Figure 5:
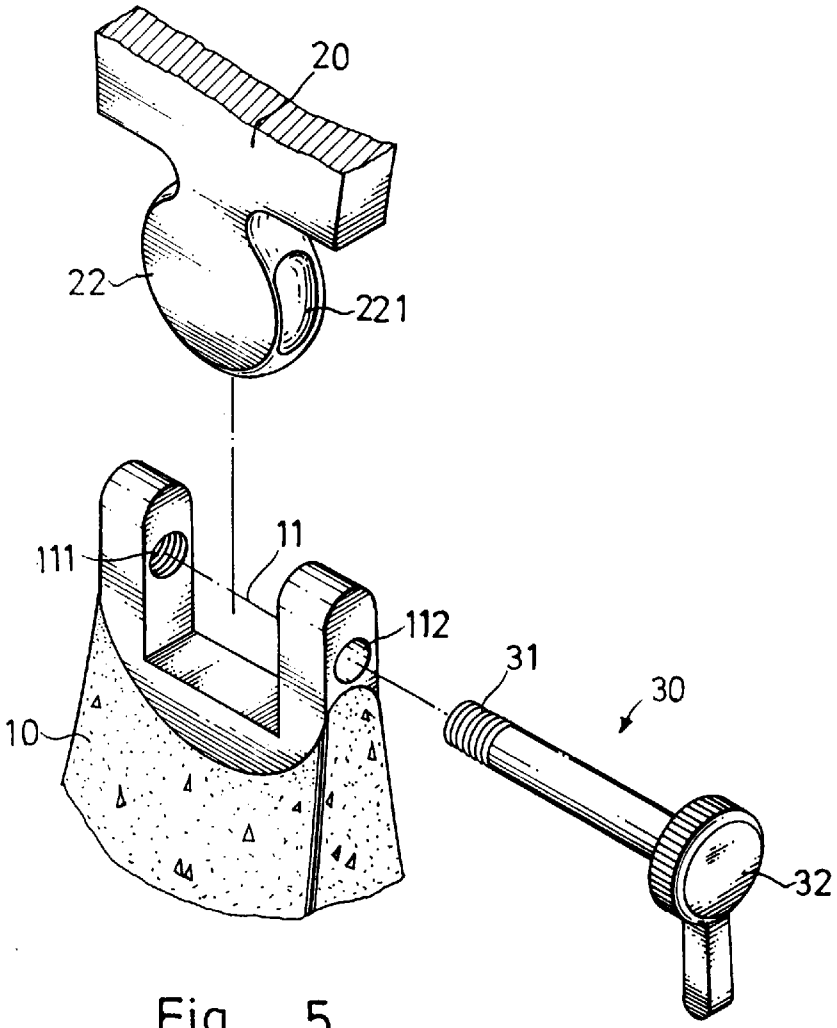
FIG. 5 is an exploded view of the hand tool angle adjustment structure according to the present invention.
Figure 4:
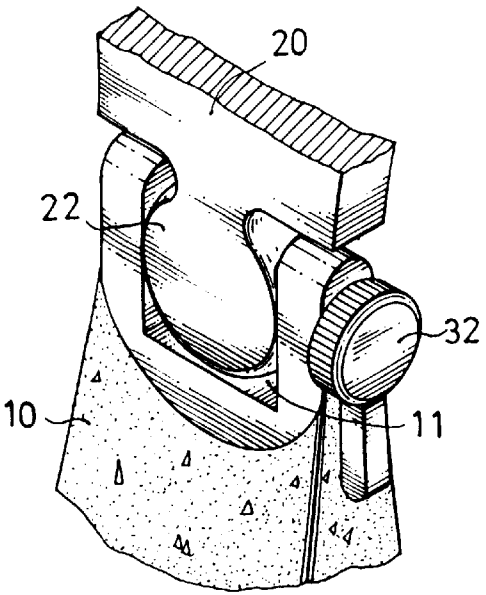
FIG. 4 is a perspective view of a hand tool angle adjustment structure according to the present invention.

Referring to FIGS. from 4 through 6, a hand tool angle adjustment structure in accordance with the present invention is shown comprised of a handle 10, a work head 20, and a lock bolt 30. The handle comprises a substantially U-shaped front coupling portion 11, a screw hole 111 and a through hole 112 aligned at two sides of the front coupling portion 11. The work head 20 can be shaped like the box end of a combination wrench or the head (the combination of the fixed jaw, the movable jaw, and the thumb screw) of a crescent wrench, comprising a flat, circular coupling portion 22 extended from the rear side thereof and a mounting hole 221 extended through two opposite lateral sides of the coupling portion 22. The lock bolt 30 has a threaded shank 31 and a hand wheel 32 at one end of the threaded shank 31. The threaded shank 31 of the lock bolt 30 is inserted through the through hole 112 at one side of the substantially U-shaped front coupling portion 11 and the mounting hole 221 of the work head 20, and then threaded into the screw hole 111 at the other side of the substantially U-shaped front coupling portion 11 to secure the work head 20 to the handle 10.

Figure 6:
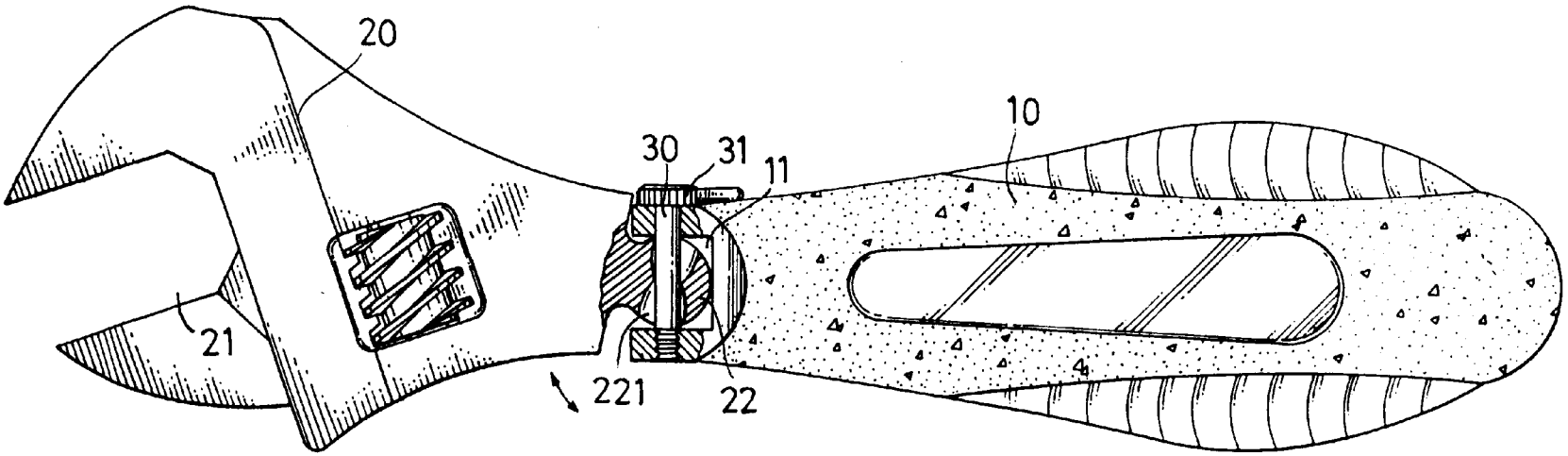
FIG. 6 is a sectional view of a crescent wrench constructed according to the present invention.
Figure 8:
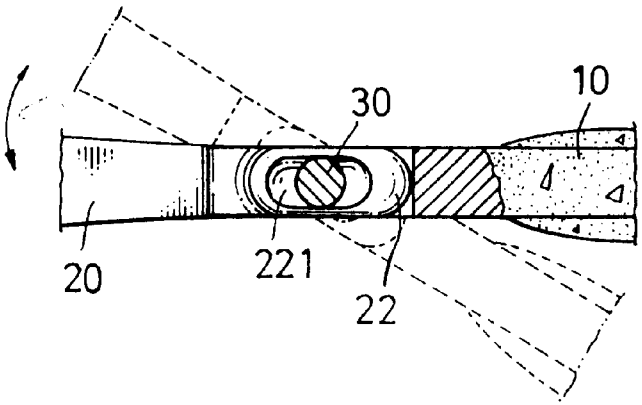
FIG. 8 is a schematic drawing showing the work head turned forwards/backwards about the threaded shank of the lock bolt according to the present invention.
Figure 7:
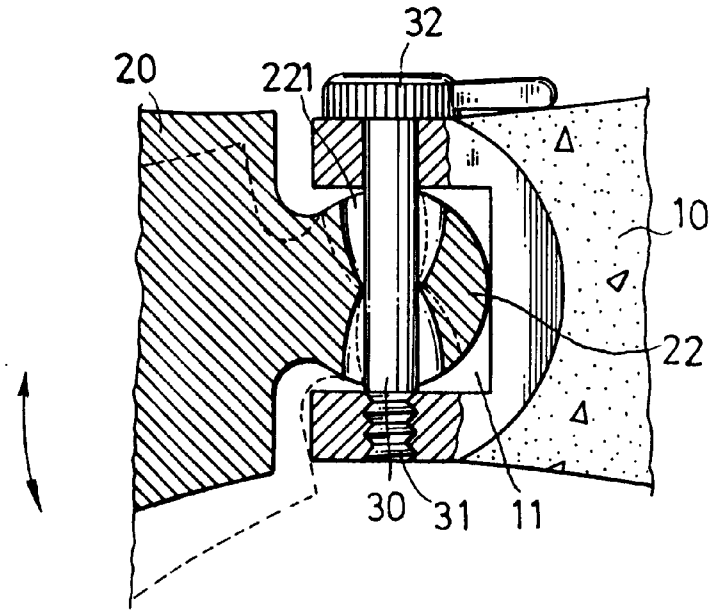
FIG. 7 is a schematic drawing showing the work head tilted leftwards/rightwards relative to the handle according to the present invention.

Referring to FIGS. 7 and 8 and FIG. 6 again, the mounting hole 221 of the work head 20 has a narrow middle portion fitting the outer diameter of the threaded shank 31 of the lock bolt 30 and two expanded end portions of oblong cross section at the two ends. The narrowest middle part of the mounting hole 221 of the work head 20 fits the outer diameter of the threaded shank 31 of the lock bolt 30. When assembled, the work head 20 can be tilted leftwards/rightwards relative to the handle 10 (see FIG. 7) or turned forwards/backwards about the threaded shank 31 of the lock bolt 30 (see FIG. 8).

Figure 9:
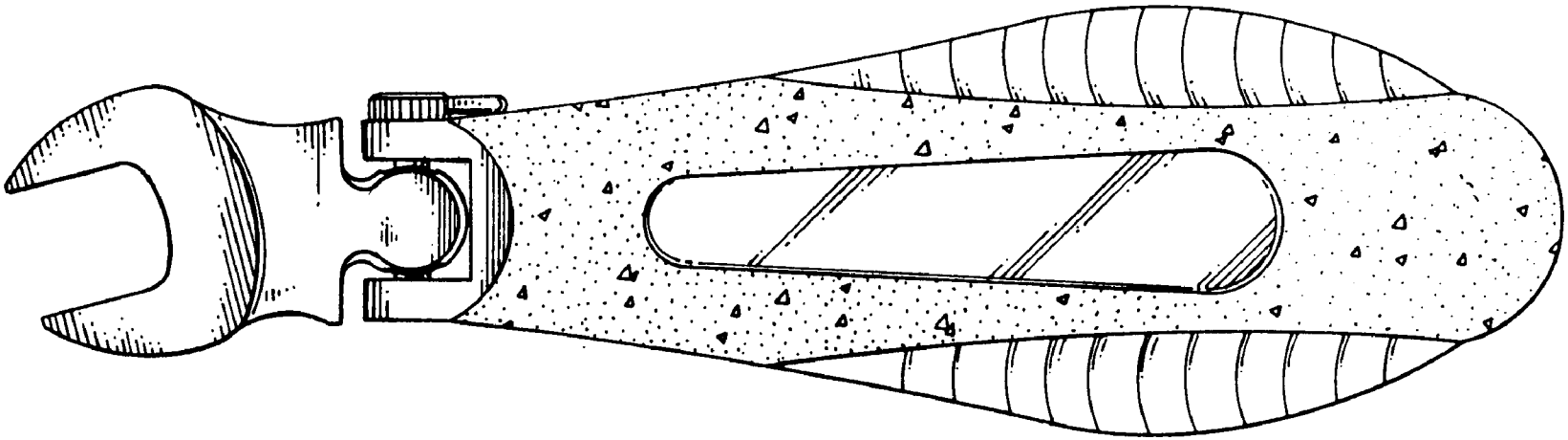
FIG. 9 illustrates an open-end wrench constructed according to the present invention.
Figure 10:
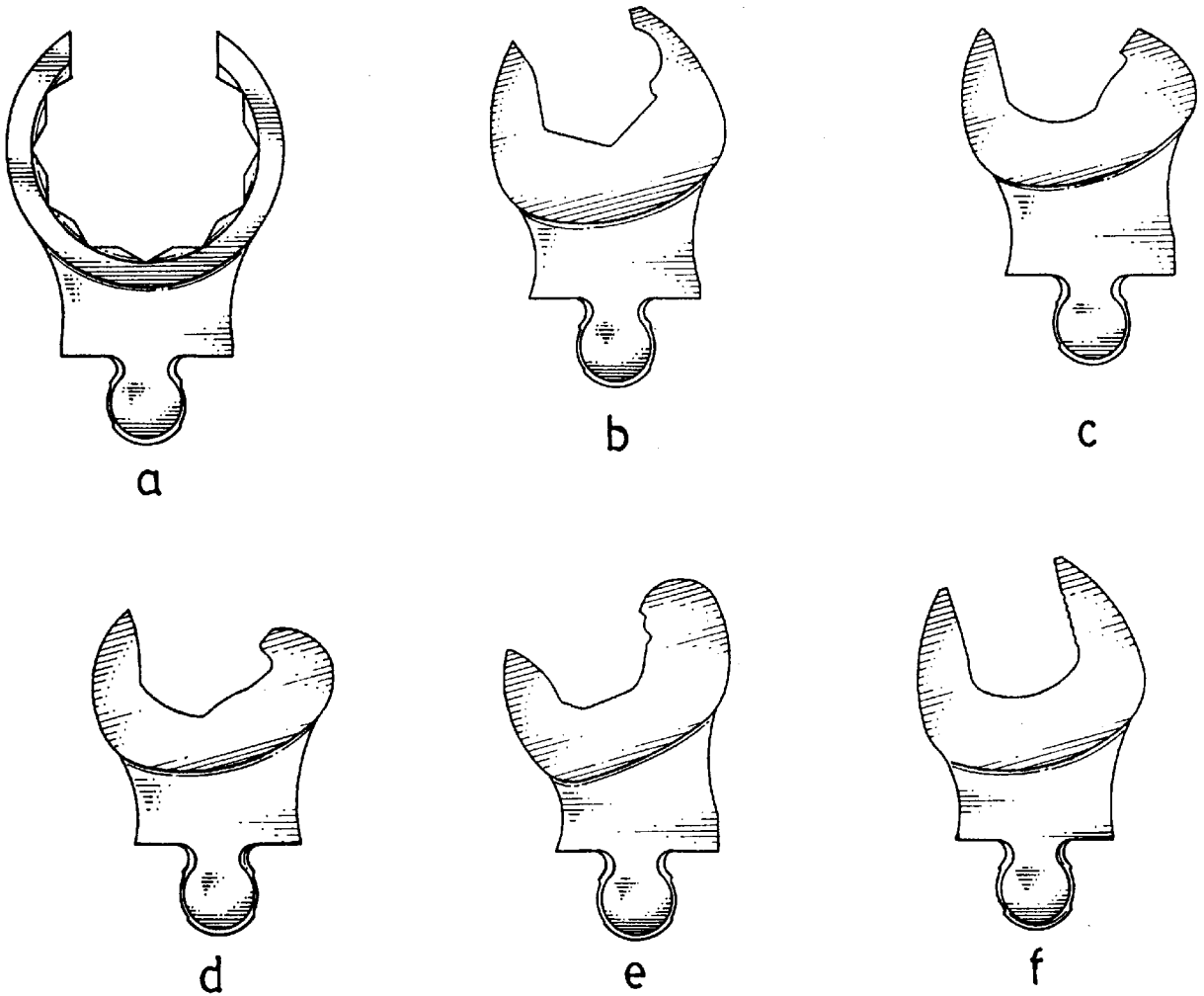
FIG. 10 shows different alternate forms of the work head according to the present invention.

In the embodiment shown in FIG. 6, the hand tool is a crescent wrench, and the mouth 21 defined between the fixed jaw and movable jaw of the work head is adjustable. In the embodiment shown in FIG. 9, the hand tool is an open-end wrench. FIGS. 10*a*~10*f* show other different alternate forms of the work head 20.

A prototype of hand tool angle adjustment structure has been constructed with the features of FIGS. 4~10. The hand tool angle adjustment structure functions smoothly to provide all of the features discussed earlier.

Although particular embodiments of the invention have been described in detail for purposes of illustration, various modifications and enhancements may be made without departing from the spirit and scope of the invention. Accordingly, the invention is not to be limited except as by the appended claims.

What the invention claimed is:

1. A hand tool angle adjustment structure comprising a handle, said handle having a substantially U-shaped front coupling portion, a screw hole transversely extended through one side of said U-shaped front coupling portion, and a through hole transversely extended through an opposite side of said U-shaped front coupling portion in axial alignment with said screw hole, a work head, said work head comprising a flat, cylindrical coupling portion extended from a rear side thereof and rotatably mounted on said U-shaped front coupling portion of said handle and a mounting hole extended through a cylindrical periphery of said cylindrical coupling portion and aligned between the through hole and the screw hole of said handle, said mounting bole having a narrow middle portion fitting the outer diameter of a threaded shank of a lock bolt and two expanded end portions of oblong cross section at two distal ends thereof, and said lock bolt being inserted through the through hole of said handle and the mounting hole of said work bead and threaded into the screw hole of said handle to secure said work head to said handle.

2. The hand tool angle adjustment structure of claim 1 wherein said lock bolt has a hand wheel provided at one end thereof for being turned by a user's one hand to thread said lock bolt in and out of the screw hole of said handle.

3. The hand tool angle adjustment structure of claim 1 wherein said work head has a mouth for grasping and turning nuts, bolts, and hex sockets.

* * * * *